US008644726B2

(12) United States Patent
Hormann et al.

(10) Patent No.: US 8,644,726 B2
(45) Date of Patent: Feb. 4, 2014

(54) HEAT SEALED REMANUFACTURED TONER CARTRIDGE

(75) Inventors: Heymo Hormann, Wilmington, IL (US); Paul Michael Korzenecki, Naperville, IL (US)

(73) Assignee: Clover Technologies Group, LLC, Ottawa, IL (US)

( * ) Notice: Subject to any disclaimer, the term of this patent is extended or adjusted under 35 U.S.C. 154(b) by 111 days.

(21) Appl. No.: 13/409,989

(22) Filed: Mar. 1, 2012

(65) Prior Publication Data

US 2013/0230334 A1 Sep. 5, 2013

(51) Int. Cl.
*G03G 15/00* (2006.01)
*G03G 15/08* (2006.01)

(52) U.S. Cl.
USPC ..... 399/109; 399/106

(58) Field of Classification Search
USPC ..... 399/109, 102, 103, 106, 262, 107
See application file for complete search history.

(56) References Cited

U.S. PATENT DOCUMENTS 4,065,335 A 12/1977 Pollack
4,599,851 A 7/1986 Williams
5,370,761 A 12/1994 Chitouras
5,460,674 A 10/1995 Chitouras
5,512,987 A 4/1996 Miller et al.
5,585,902 A 12/1996 Nishiuwatoko et al.
5,826,140 A 10/1998 Zona et al.
5,876,541 A 3/1999 Chitouras
5,895,149 A * 4/1999 Weed ..... 399/262
6,097,907 A 8/2000 Fujiwara
6,370,349 B2 * 4/2002 Tsuji et al. ..... 399/262
6,501,924 B2 12/2002 Nagashima
6,587,657 B2 7/2003 Sirejacob
7,505,708 B2 * 3/2009 Ohanyan et al. ..... 399/109
7,676,173 B2 * 3/2010 Ohanyan ..... 399/109
2008/0003870 A1 * 1/2008 Wu et al. ..... 439/567

* cited by examiner

*Primary Examiner* — Sophia S Chen

(57) ABSTRACT

A remanufactured toner cartridge includes a wall defining a fill hole that is used to refill the cartridge with toner. A patch covers the fill hole, and a heat activated adhesive non-removably attaches the patch to the wall. The fill hole can be formed with a heat knife such that when the heat knife is withdrawn it forms a raised ridge of material extending around the perimeter of the fill hole. The patch is attached to the wall by applying heat and pressure to the patch, which also softens and at least partially flattens the ridge of material surrounding the fill hole such that the patch is substantially flush with the wall upon completion of the operation.

26 Claims, 2 Drawing Sheets

HEAT SEALED REMANUFACTURED TONER CARTRIDGE

TECHNICAL FIELD

This invention relates generally to remanufactured toner cartridges and, more specifically, remanufactured toner cartridges that are heat sealed so that they may be reused by a printing device.

BACKGROUND

High volume printing devices, such as those used as network printers, are typically designed to use toner cartridges which store and transmit ink in the form of toner to an intended medium such as paper. Once the toner is depleted from the toner cartridge, the cartridge is removed from the printing device and is typically disposed of. The cartridge is replaced by a new toner cartridge in the printing device so that printing may continue.

With an ever growing focus on protecting the environment, a significant interest in refilling emptied toner cartridges to avoid disposal in landfills has emerged. Currently, refilling a toner cartridge involves drilling or cutting a hole in the toner storage area of the toner cartridge, also known generally as the hopper, and thereafter dispensing additional toner through the hole and into the hopper by way of a needle, tube, funnel, or other device. Once refilling is complete, the fill hole is closed using a pressure-sensitive foam patch or a push-in plastic plug.

SUMMARY

In some aspects, a remanufactured toner cartridge includes a wall defining a fill hole that is used to refill the cartridge with toner. A patch covers the fill hole, and a heat activated adhesive non-removably attaches the patch to the wall.

In other aspects, a remanufactured toner cartridge includes a body defining a toner chamber for storing toner. The body includes a wall having formed therein a fill hole communicating with the toner chamber and affording access to the toner chamber for refilling the toner chamber with toner. A heat activated patch is non-removably attached to the wall and completely covers the fill hole. The heat activated patch includes a heat activated adhesive on at least one side thereof for forming a seal between the wall and the heat activated patch.

In still other aspects, a fill hole is formed in a wall of a remanufactured toner cartridge. The fill hole is used to refill the toner cartridge with toner. A method for sealing the fill hole includes positioning a patch over the fill hole. The patch includes a heat activated adhesive on at least one side. The method further includes applying heat and pressure to the patch thereby activating the heat activated adhesive and non-removably attaching the patch to the wall.

In still other aspects, a toner cartridge includes a body defining a toner chamber and a wall, and a method for remanufacturing the toner cartridge includes piercing the wall with a heat knife to form a fill hole. The method also includes withdrawing the heat knife from the wall to thereby form a raised ridge around the perimeter of the fill hole. A patch is positioned on the raised ridge and over the fill hole. The patch includes a heat activated adhesive on at least one side thereof. Heat and pressure are applied to the patch thereby activating the heat activated adhesive, softening and at least partially flattening the ridge, and non-removably attaching the patch to the wall.

In the following detailed description, various details are set forth by way of examples to provide a thorough understanding of certain concepts and teachings. While the invention is capable of being practiced and carried out in a variety of ways, at least one embodiment will be described herein in detail with the understanding that the present disclosure is provided to highlight and exemplify certain principles of the invention and should not be regarded as limiting the scope of the invention only to the embodiment(s) illustrated and described.

DETAILED DESCRIPTION

Figure 1:
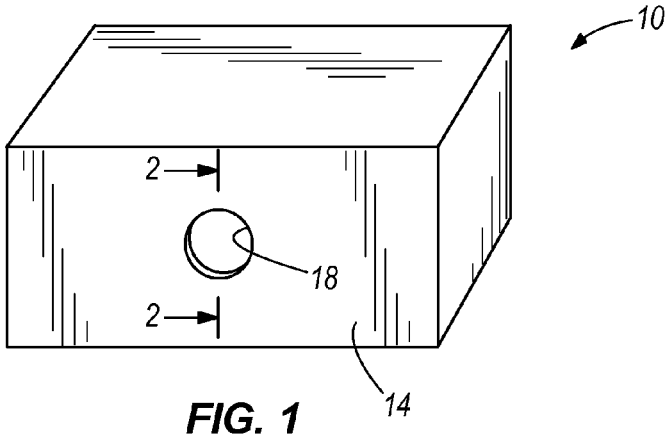
FIG. 1 is a schematic representation of a toner cartridge having a fill hole formed in a sidewall thereof, the fill hole communicating with a toner storage area.

FIG. 1 schematically illustrates a toner cartridge 10 of the type used in a printing or copying device. The exemplary toner cartridge 10 is configured such that, after an initial supply of toner has been depleted, the toner cartridge can be remanufactured and refilled with additional toner for subsequent reuse of the cartridge 10. More specifically, after the initial supply of toner is depleted, many of the components in the toner cartridge are still in useable condition and therefore can be reused. Any unusable components may be repaired or replaced, and the cartridge can then be refilled with toner so that the cartridge may be reused in the printing or copying device. The cartridge 10 can be any type of toner cartridge for use with any type of printing or copying device. By way of example only, and depending on the specific application, the toner cartridge 10 may include a variety of features such as a drum, a waste bin, various locating features, and the like.

Figure 2:
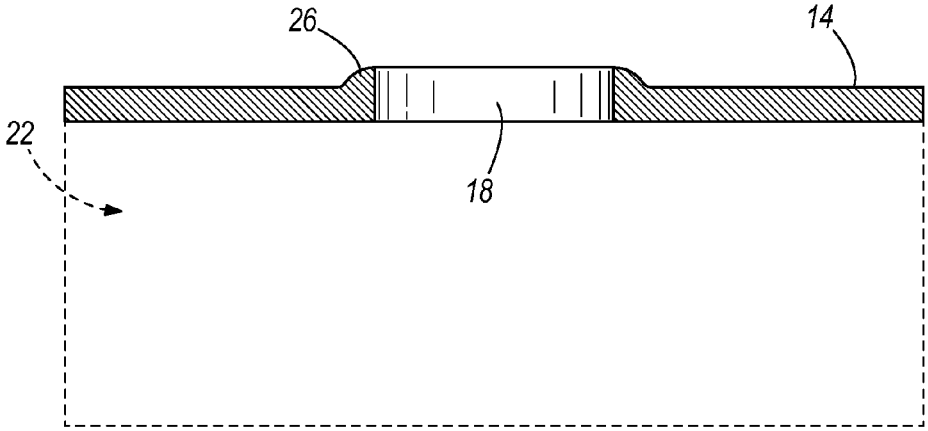
FIG. 2 is a section view taken along line 2-2 of FIG. 1.

Referring also to FIG. 2, the cartridge 10 includes a wall 14 that, when a fill hole 18 or other aperture is formed therein, affords access to an internal toner storage area or toner chamber 22 that stores the toner. The wall 14 can be positioned directly adjacent the toner chamber 22 in the manner shown, such that the fill hole 18 communicates directly with the toner chamber 22, or the wall 14 can be spaced from the toner chamber 22 and the fill hole 18 can communicate with the toner chamber 22 by way of a tube, channel, or other passageway formed or positioned in the interior of the cartridge 10. As discussed below, the illustrated fill hole 18 is created using a heat knife, but the hole can also be created using other techniques such as drilling, boring, laser cutting, and the like. In other embodiments, the cartridge 10 may include a pre-existing fill hole 18 formed during an initial filling operation or during a prior re-filling operation.

To cut the fill hole 18 using a heat knife (not shown), the heat knife is heated to an appropriate temperature for cutting through the material defining the wall 14 of the cartridge 10. By way of example only, when the cartridge 10 is formed of polystyrene, the heat knife can be heated to temperatures between about 460 and 500 degrees Fahrenheit. In other embodiments, when the cartridge is formed of polyethylene, the heat knife can be heated to temperatures between about 260 and 300 degrees Fahrenheit. Once the knife reaches the desired temperature, the knife is moved into contact with and through the wall 14, thereby piercing the wall 14 and forming the fill hole 18. In the illustrated embodiment, the knife is substantially cylindrical and the resulting fill hole 18 is therefore substantially circular, but other shapes may also be used. As the knife is withdrawn from the cartridge, some of the locally heated and softened material of the wall 14 is drawn outwardly with the knife and thereby forms a ridge 26 of raised wall material extending generally around a perimeter of the fill hole 18. After the knife is completely withdrawn the raised wall material of the ridge 26 cools and solidifies. Once the knife has retracted from the fill hole 18 an ejector pin can be used to knock the disk of material removed from the wall 14 out of the knife.

Once the fill hole 18 has been formed in the wall 14, the toner chamber 22 optionally can be cleaned to remove any residual toner using a variety of cleaning techniques. Toner is then added to the toner chamber 22 through the fill hole 18 using one or more filling techniques. For example, tubes, funnels, needles, channels, and other material guidance and transportation structure can be used to guide or channel toner through the fill hole 18 and into the toner chamber 22.

After refilling the toner chamber 22 with the appropriate amount of toner, the fill hole 18 is covered, plugged, or otherwise closed to prevent the toner from leaking out of the fill hole 18. In this regard, and with reference also to FIGS. 3-6, a heat sealing patch 30 can be used to cover the fill hole 18. In the illustrated example, the heat sealing patch 30 is a disk of a polymer film, such as polyester film, coated on at least one side with a heat-activated adhesive 32, such as a hot melt adhesive. One example of a commercially available film from which the patch 30 can be formed is bonding film ST-1218 available from The Strouse Corporation of Westminster, Md. It should be appreciated that materials other than polyester and heat-activated adhesives other than hot melt adhesives can also be used without departing from the spirit and scope of the present invention.

Figure 3:
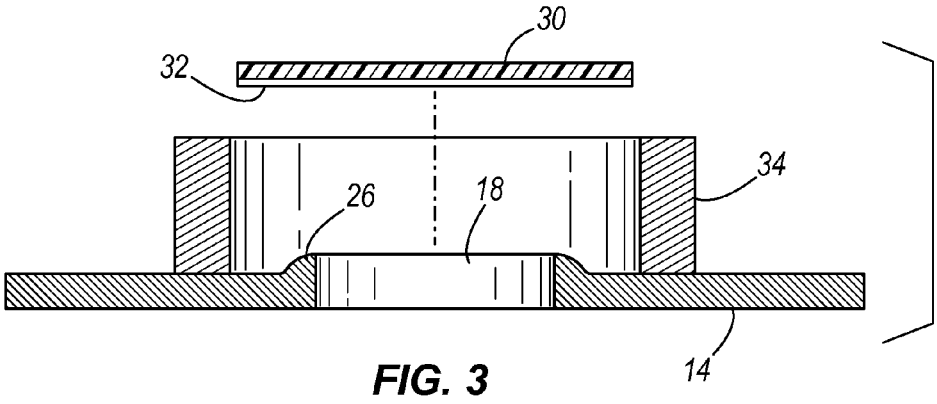
FIG. 3 is a section view similar to FIG. 2 and showing a guide bushing positioned over the fill hole before a sealing operation.

In some embodiments, to cover the fill hole 18 with the patch 30, a guide bushing 34 is positioned around the fill hole 18 and contacts the wall 14 (FIG. 3). In other embodiments, pre-existing features of the cartridge 10 may require the use of a guide bushing having a different configuration (e.g., non-cylindrical) than the guide bushing 34 of FIG. 3. In still other embodiments the fill hole 18 may be formed adjacent to certain pre-existing features of the cartridge 10 such as tabs, projections, ribs, and the like, such that the pre-existing feature or features can be used to locate the heat sealing patch 30 over the fill hole 18. In such instances a guide bushing may not be required at all.

Figure 4:
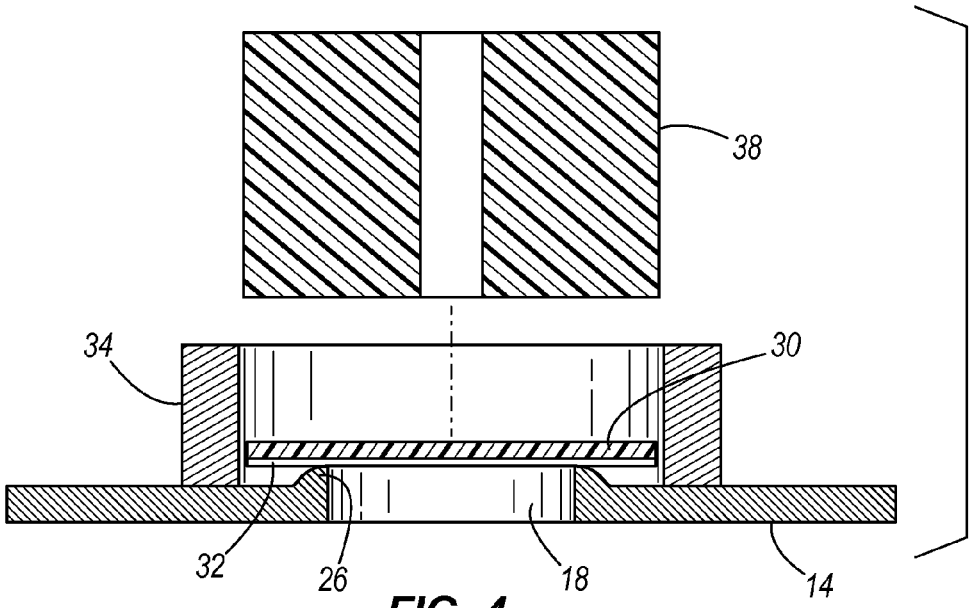
FIG. 4 is a section view similar to FIG. 2 and showing a heat seal patch positioned over the fill hole and a heated die in a raised position before a sealing operation.
Figure 5:
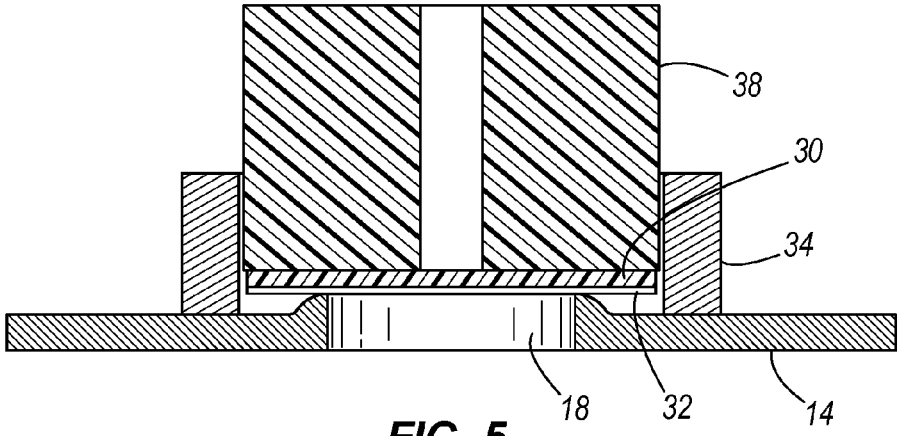
FIG. 5 is a section view similar to FIG. 2 and showing the heated die of FIG. 4 in a lowered position during a sealing operation.
Figure 6:
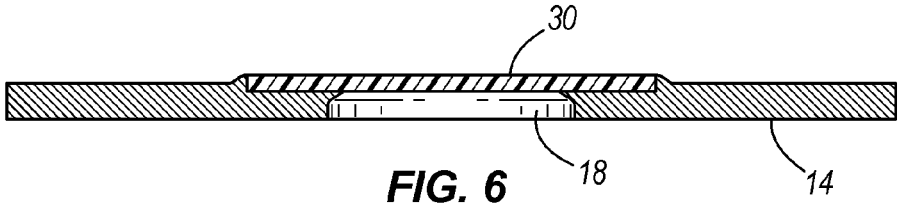
FIG. 6 is a section view similar to FIG. 2 and showing the heat seal patch after a sealing operation.

In the illustrated embodiment, the patch 30 is positioned over the fill hole 18 and lowered into the guide bushing 34 such that the outer edges of the patch 30 overlie the ridge 26 that surrounds the fill hole 18 (FIG. 4). The patch 30 can be positioned manually or using appropriately configured automation equipment. A heated die 38 is moved into position above the patch 30 and fill hole 18. The heated die 38 is sized to fit closely within the guide bushing 34. The heated die 38 is brought into contact with the patch 30 (FIG. 5). The heated die 38 applies heat and pressure to the patch 30, the adhesive 32, and the wall 14. In some operations the patch 30 is carried with the heated die 38 such that movement of the heated die 38 toward the wall 14 also moves the patch 30 into position over the fill hole 18.

With the patch 30 pressed against the wall 14, heat from the heated die 38 activates the adhesive 32 on the patch 30 and also softens the material defining the ridge 26 that surrounds the fill hole 18. The die 38 continues to press the patch 30 against the wall 14 for a duration of time sufficient to ensure proper adhesion of the patch 30 to the wall 14. The combination of pressure and heat bonds the patch 30 to the wall 14 and also at least partially flattens the ridge 26 such that when the operation is complete and the die 38 is retracted, the patch 30 is flush or substantially flush with the outer surface of the wall 14 (see FIG. 6). The resulting bond between the patch 30 and the wall 14 forms a substantially air tight and fluid tight seal to prevent toner from escaping through the fill hole 18.

The size and shape of the heated die 38 generally, but not necessarily, corresponds to the size and shape of the patch 30 and fill hole 18. For example, the heated die 38 can be circular or cylindrical in cross-section. Furthermore, it may be advantageous to select a patch 30 including a heat-activated adhesive 32 having an activation temperature that is substantially similar to the softening temperature of the material that defines the ridge 26. By way of example only, in one embodiment the wall 14 of the cartridge 10 is formed of polystyrene, which has a softening temperature of about 270° F. to about 280° F., and the heated die 38 is heated to a temperature of between about 300° F. and about 350° F. The heated die 38 presses the patch 30 against the wall 14 with between about 10 psi and about 20 psi of pressure for a dwell time of between about 2 and about 5 seconds, which is generally sufficient to both flatten the ridge 26 and activate the heat-activated adhesive 32. It should be appreciated that the specific temperatures, pressures and times can vary and may depend upon the specific materials used in a particular application. For example, increasing the pressure can improve heat transfer and allow the temperature and/or the dwell time to be reduced. However, the amount of pressure that can be applied may be limited by the structural integrity of the wall 14.

After the heated die 38 is withdrawn and the part is cooled, the patch 30 is non-removably attached to the wall, which is to say that although it may be possible to remove the patch 30 using extraordinary means, the patch 30 is intended to remain securely in place throughout the useful life of the remanufactured print cartridge 10.

What is claimed is:

1. A remanufactured toner cartridge comprising:

a wall defining a fill hole used to refill the cartridge with toner;

a patch covering the fill hole; and, a heat activated adhesive non-removably attaching the patch to the wall, wherein the wall is formed of a first material, and wherein the heat activated adhesive has an activation temperature substantially similar to a softening temperature of the first material.

2. The remanufactured toner cartridge of claim 1, wherein the patch is formed of a second material.

3. The remanufactured toner cartridge of claim 2, wherein the first material is polystyrene and the second material is polyester.

4. The remanufactured toner cartridge of claim 1, wherein a perimeter of the fill hole includes a raised ridge when the fill hole is used to refill the cartridge with toner, and wherein application of the patch at least partially flattens the ridge such that the patch is substantially flush with the wall.

5. The remanufactured toner cartridge of claim 1, wherein the patch creates a substantially air tight and fluid tight seal.

6. A remanufactured toner cartridge comprising:

a body defining a toner chamber for storing toner, the body including a wall having formed therein a fill hole communicating with the toner chamber and affording access to the toner chamber for refilling the toner chamber with toner; and, a heat activated patch non-removably attached to the wall and completely covering the fill hole, the heat activated patch including a heat activated adhesive on at least one side thereof for forming a seal between the wall and the heat activated patch, wherein the wall is formed of a first material, and wherein the heat activated adhesive has an activation temperature substantially similar to a softening temperature of the first material.

7. The remanufactured toner cartridge of claim 6, wherein the patch is formed of a second material.

8. The remanufactured toner cartridge of claim 7, wherein the first material is polystyrene and the second material is polyester.

9. The remanufactured toner cartridge of claim 6, wherein a perimeter of the fill hole includes a raised ridge when the fill hole is used to refill the toner chamber with toner, and wherein application of the heat activated patch at least partially flattens the ridge such that the heat activated patch is substantially flush with the wall.

10. The remanufactured toner cartridge of claim 6, wherein the seal between the wall and the heat activated patch is substantially air tight and substantially fluid tight.

11. A method for sealing a fill hole formed in a wall of a remanufactured toner cartridge, the fill hole used to refill the toner cartridge with toner, the method comprising:

positioning a patch over the fill hole, the patch including a heat activated adhesive on at least one side thereof; and, applying heat and pressure to the patch thereby activating the heat activated adhesive and non-removably attaching the patch to the wall, wherein positioning the patch over the fill hole includes positioning a guide bushing around the fill hole and positioning the patch within the guide bushing.

12. The method of claim 11, wherein applying heat and pressure to the patch includes contacting the patch with a heated die.

13. The method of claim 11, wherein a perimeter of the fill hole includes ridge that is raised with respect to the wall, and wherein applying heat and pressure to the patch softens and at least partially flattens the ridge.

14. A method for remanufacturing a toner cartridge, the toner cartridge including a body defining a toner chamber and a wall, the method comprising:

piercing the wall with a heat knife to form a fill hole;

withdrawing the heat knife from the wall thereby forming a raised ridge around the perimeter of the fill hole;

positioning a patch on the raised ridge and over the fill hole, the patch including a heat activated adhesive on at least one side thereof; and, applying heat and pressure to the patch thereby activating the heat activated adhesive, softening and at least partially flattening the ridge, and non-removably attaching the patch to the wall.

15. The method of claim 14, wherein applying heat and pressure to the patch includes contacting the patch with a heated die.

16. The method of claim 14, wherein positioning the patch on the raised ridge and over the fill hole includes positioning a guide bushing around the fill hole and positioning the patch within the guide bushing.

17. A remanufactured toner cartridge comprising:

a wall defining a fill hole used to refill the cartridge with toner;

a patch covering the fill hole; and, a heat activated adhesive non-removably attaching the patch to the wall, wherein a perimeter of the fill hole includes a raised ridge when the fill hole is used to refill the cartridge with toner, and wherein application of the patch at least partially flattens the ridge such that the patch is substantially flush with the wall.

18. The remanufactured toner cartridge of claim 17, wherein the wall is formed of a first material and the patch is formed of a second material.

19. The remanufactured toner cartridge of claim 18, wherein the first material is polystyrene and the second material is polyester.

20. The remanufactured toner cartridge of claim 17, wherein the patch creates a substantially air tight and fluid tight seal.

21. A remanufactured toner cartridge comprising:

a body defining a toner chamber for storing toner, the body including a wall having formed therein a fill hole communicating with the toner chamber and affording access to the toner chamber for refilling the toner chamber with toner; and, a heat activated patch non-removably attached to the wall and completely covering the fill hole, the heat activated patch including a heat activated adhesive on at least one side thereof for forming a seal between the wall and the heat activated patch, wherein a perimeter of the fill hole includes a raised ridge when the fill hole is used to refill the toner chamber with toner, and wherein application of the heat activated patch at least partially flattens the ridge such that the heat activated patch is substantially flush with the wall.

22. The remanufactured toner cartridge of claim 21, wherein the wall is formed of a first material and the patch is formed of a second material.

23. The remanufactured toner cartridge of claim 22, wherein the first material is polystyrene and the second material is polyester.

24. The remanufactured toner cartridge of claim 21, wherein the seal between the wall and the heat activated patch is substantially air tight and substantially fluid tight.

25. A method for sealing a fill hole formed in a wall of a remanufactured toner cartridge, the fill hole used to refill the toner cartridge with toner, the method comprising:

positioning a patch over the fill hole, the patch including a heat activated adhesive on at least one side thereof; and, applying heat and pressure to the patch thereby activating the heat activated adhesive and non-removably attaching the patch to the wall, wherein a perimeter of the fill hole includes ridge that is raised with respect to the wall, and wherein applying heat and pressure to the patch softens and at least partially flattens the ridge.

26. The method of claim 25, wherein applying heat and pressure to the patch includes contacting the patch with a heated die.

* * * * *